US009554633B1

(12) United States Patent
Briggins

(10) Patent No.: US 9,554,633 B1
(45) Date of Patent: Jan. 31, 2017

(54) HAIR BRAIDING APPARATUS

(71) Applicant: Kimberly Briggins, Birmingham, AL (US)

(72) Inventor: Kimberly Briggins, Birmingham, AL (US)

( * ) Notice: Subject to any disclaimer, the term of this patent is extended or adjusted under 35 U.S.C. 154(b) by 0 days.

(21) Appl. No.: 15/060,858

(22) Filed: Mar. 4, 2016

Related U.S. Application Data

(60) Provisional application No. 62/194,629, filed on Jul. 20, 2015.

(51) Int. Cl.
*A45D 6/02* (2006.01)
*A45D 2/00* (2006.01)

(52) U.S. Cl.
CPC ..... *A45D 2/00* (2013.01); *A45D 2002/005* (2013.01)

(58) Field of Classification Search
CPC ..... A45D 2/00; A45D 2002/003; A45D 2002/005; A45D 2002/006
See application file for complete search history.

(56) References Cited

U.S. PATENT DOCUMENTS 4,038,996 A * 8/1977 Eronini ..... A45D 2/00 132/271
4,369,690 A 1/1983 Sapkus
5,488,963 A 2/1996 Fishman
5,758,670 A 6/1998 Ogunro
6,109,275 A 8/2000 Medezmonsanto
6,164,289 A 12/2000 Ogunro et al.
6,499,491 B2 12/2002 Kennedy et al.
6,575,175 B2 6/2003 Kim et al.
8,087,414 B2 1/2012 Gutierrez Ugarte
8,726,821 B2 5/2014 White et al.
2003/0230316 A1* 12/2003 Glucksman ..... A45D 2/00 132/212
2014/0048091 A1* 2/2014 Chung ..... A45D 7/00 132/200

* cited by examiner

*Primary Examiner* — Rachel Steitz
(74) *Attorney, Agent, or Firm* — Dale J. Ream

(57) ABSTRACT

A hair braiding apparatus includes a main housing having a lower portion defining a lower interior area. A rotor assembly is mounted to the lower portion of the main housing and includes a rotor motor having a plurality of rotors operatively coupled to the rotor motor. The rotor assembly includes at least a pair of orbital tracks configured to receive the plurality of rotors for movement therealong. A plurality of hair retention members are coupled to respective rotors for positioning hair to be styled. A processor is positioned in the lower portion and electrically connected to the rotors for actuating the rotors to move along the orbital tracks. A memory stores programming instructions to selectively control movement of the rotors and the platform.

20 Claims, 24 Drawing Sheets

HAIR BRAIDING APPARATUS

REFERENCE TO RELATED APPLICATIONS

This application claims the benefit of provisional patent application U.S. Ser. No. 62/194,629 filed Jul. 20, 2016 titled Hair Braiding Apparatus and which is incorporated herein by reference.

BACKGROUND OF THE INVENTION

This invention relates to a hair braiding apparatus in which strands of a person's hair may be connected to the apparatus and automatically manipulated into a standard braid and other hair styles according to the user-selectable programming instructions that control corresponding rotors.

Both men and women frequently go to hair salons to have a beautician style their hair. For instance, a lady may desire to have her hair braided. There are other styles that also involve the rotation or twisting of hair, such as a technique referred to as corn rolls. While each of these procedures may require a significant amount of time, the rotation or intertwining of the hair follows a repetitious technique that may in some cases be accomplished by a machine.

Various devices and proposals have been proposed in the prior art for a hair braiding machine. Although presumably effective for their intended purposes, each of the existing and proposed devices seek to braid hair according to a predetermined pattern, such as a traditional braid.

Therefore, it would be desirable to have a hair braiding apparatus under computer control that can style a person's hair in braiding and similar techniques. Further, it would desirable to have a hair braiding apparatus having hair gripping devices coupled to rotors operated in rotational patterns according to computer instruction. In addition, it would be desirable to have a hair braiding apparatus that allows a user to select from multiple choices in hair styles.

SUMMARY OF THE INVENTION

A hair braiding apparatus according to the present invention includes a main housing having a lower portion defining a lower interior area. A rotor assembly is mounted to the lower portion and includes a rotor motor having a plurality of rotors operatively coupled to the rotor motor. The rotor assembly includes at least a pair of orbital tracks configured to receive the plurality of rotors for movement therealong. A plurality of hair retention members are coupled to respective rotors for positioning hair to be styled. A processor is positioned in the lower portion and electrically connected to the rotors for actuating the rotors to move along the orbital tracks. A non-transient storage medium, i.e. a memory, stores programming instructions to selectively control actuation of the rotor motor so as to move respective rotors to style strands of hair in held by the retention members.

Therefore, a general object of this invention is to provide a hair braiding apparatus that automatically arranger hair into predetermined patterns under computer control.

Another object of this invention is to provide a hair braiding apparatus, as aforesaid, in which a user can select a hair style to direct the apparatus to weave.

Still another object of this invention is to provide a hair braiding apparatus, as aforesaid, that utilizes a platform that selectively changes position as strands of hair are placed into a desired position.

Yet another object of this invention is to provide a hair braiding apparatus, as aforesaid, that is easy and safe to use.

A further object of this invention is to provide a hair braiding apparatus, as aforesaid, that creates beautiful hair styles with the push of a button.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1:
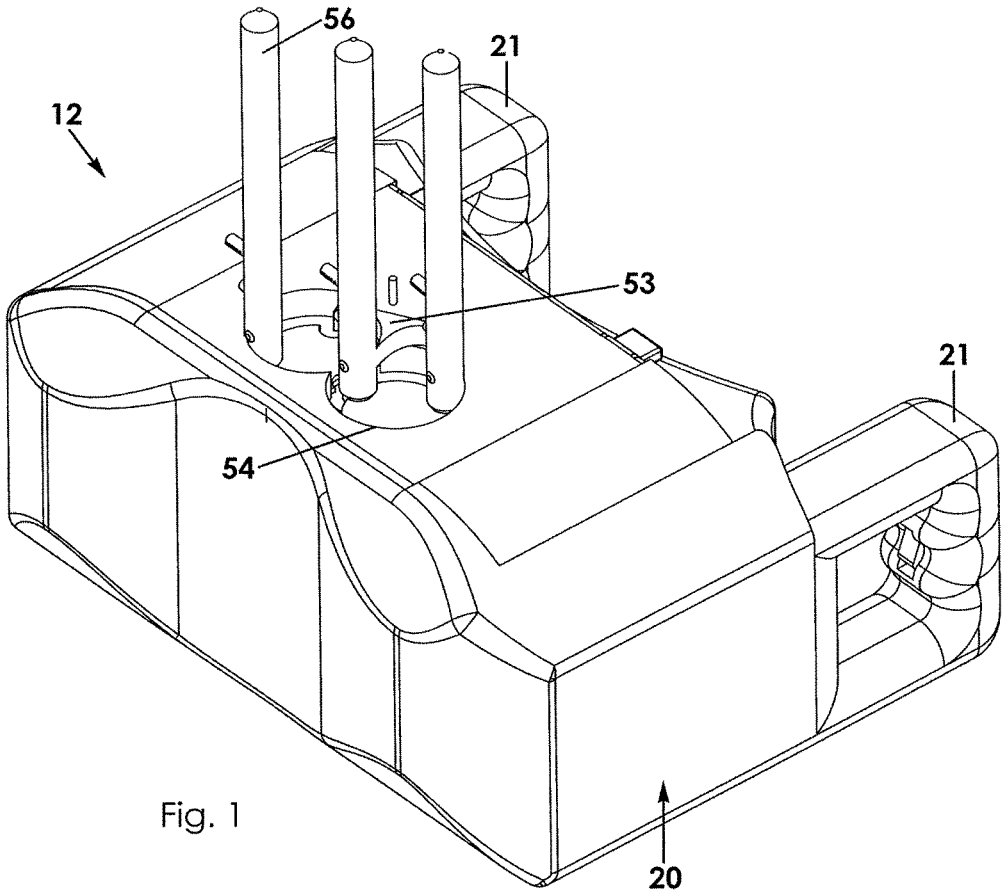
FIG. 1 is a perspective view of a hair braiding apparatus according to a preferred embodiment of the present invention.

A hair braiding apparatus according to a preferred embodiment of the present invention will now be described with reference to FIGS. 1 to 24 of the accompanying drawings. The hair braiding apparatus 10 includes a main housing 12 having a lower portion 20 and a upper portion 30. A platform housing 40 is mounted to the upper portion 30 and configured to move downwardly along a front surface of the upper portion 30. A rotor assembly 50 is mounted to the lower portion 20 and includes a plurality of rotors 52 movable about at least a pair of orbital tracks 54 according to programming executed by a processor 70 as directed by user controls.

In an embodiment, the lower portion 20 of the main housing 12 may have bottom, side, and top walls arranged in a generally rectangular or box shape suitable to sit on a vanity, table, or countertop. The lower portion 20 also includes a rear wall 13. The lower portion 20 may include structures that are ergonomic and suitable to be handheld by a beautician or by a friend or family member of a person whose hair is to be braided. For instance, one handle or a pair of spaced apart handles 21 may extend rearwardly from the rear wall 13 of the lower portion 20 of the main housing 12. The walls of the lower portion 20 together define a lower portion interior area 22 configured to contain electronics, such as a battery 76, a processor 70, memory 72, or a circuit board 74 containing those components. The electronic components of the present invention are shown most particularly in FIG. 24.

A rotor assembly 50 is situated in an interior space defined by the lower portion 20 of the main housing 12. The rotor assembly 50 includes a rotor motor 55 situated in the lower portion 20 and a plurality of rotors 52 are operatively coupled to the rotor motor 55, each rotor 52 extending upwardly. The rotor assembly 50 includes at least a pair of orbital tracks 54 adjacent one another atop the lower portion 20 and into which the rotors 52 are received. Preferably, the rotor motor 55 and platform motor 42 (described later) are electrically coupled to a battery 76 as a source of electricity although direct connection to AC power 78 via an electrical cord would also work.

Figure 5:
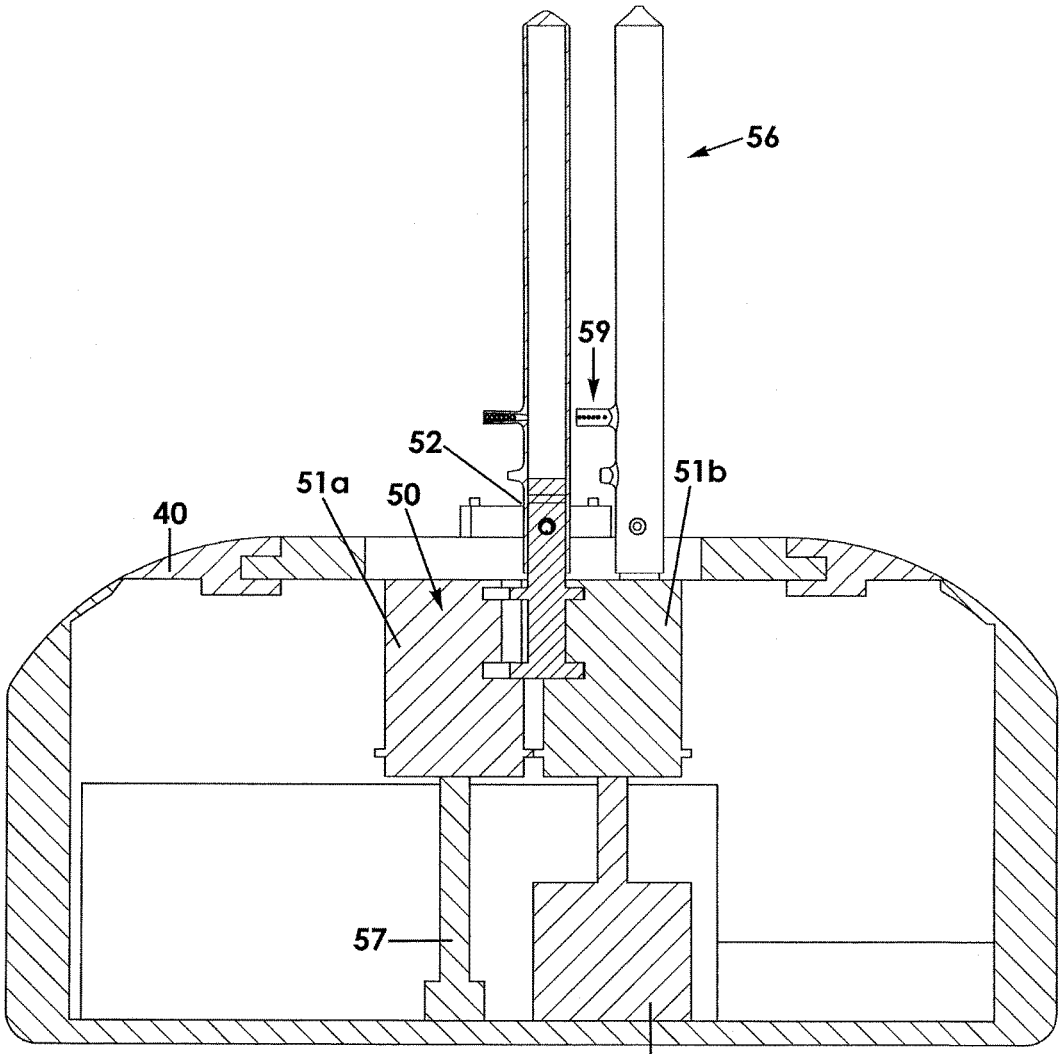
FIG. 5 is a section view taken along line 5-5 of FIG. 4*b;*
Figure 6A:
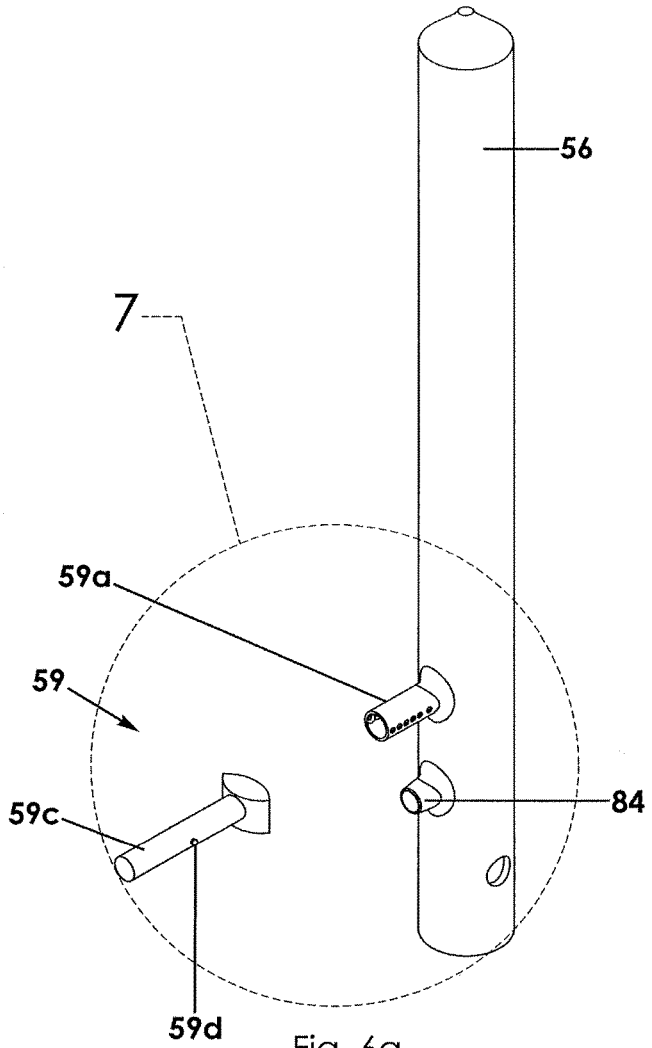
FIG. 6*a* is an exploded view of hair retention member with hair clamping assembly.
Figure 6B:
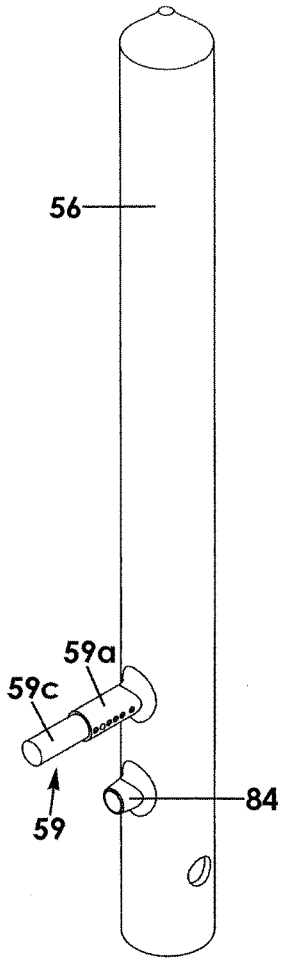
FIG. 6*b* is a perspective view of the retention member with hair clamping assembly illustrated in an assembled configuration.
Figure 7:
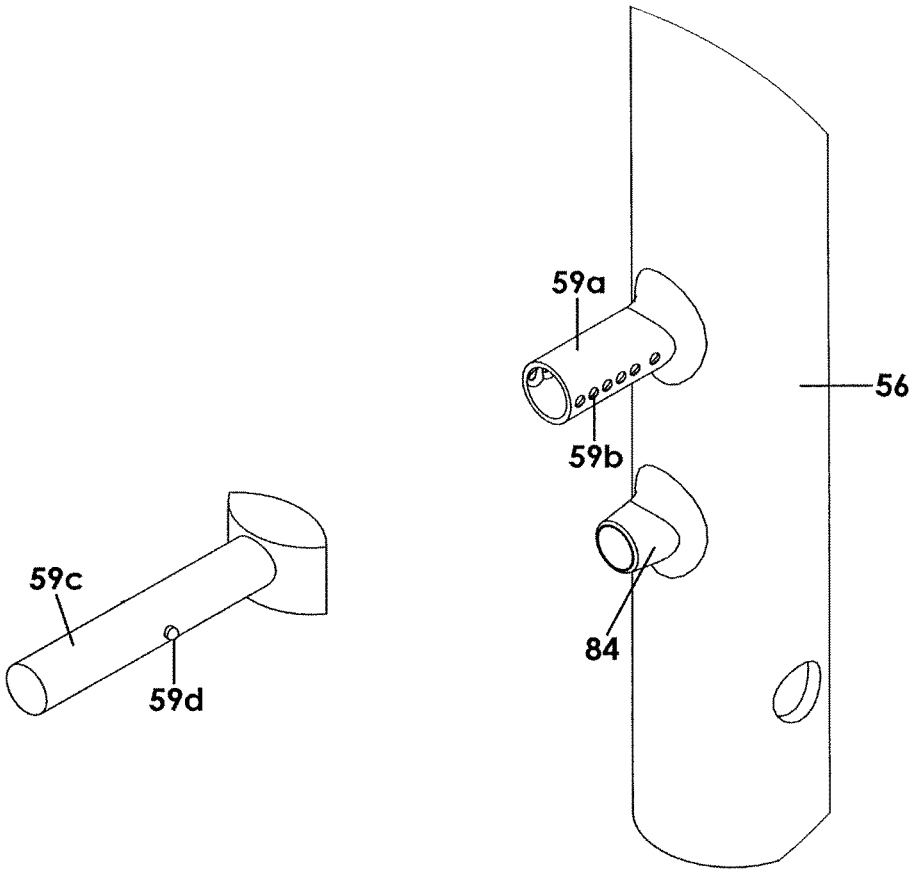
FIG. 7 is an isolated enlarged view of the hair clamping assembly taken from FIG. 6*a;*
Figure 8A:
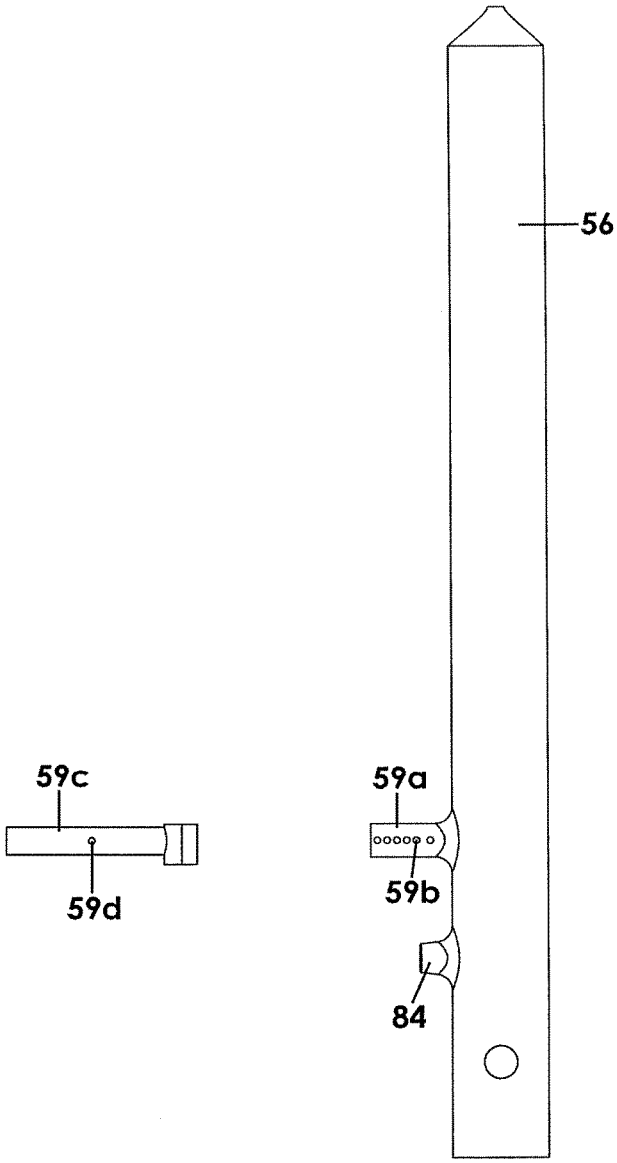
FIG. 8*a* is a side view of the hair retention member and hair clamping assembly as in FIG. 6*a;*
Figure 8B:
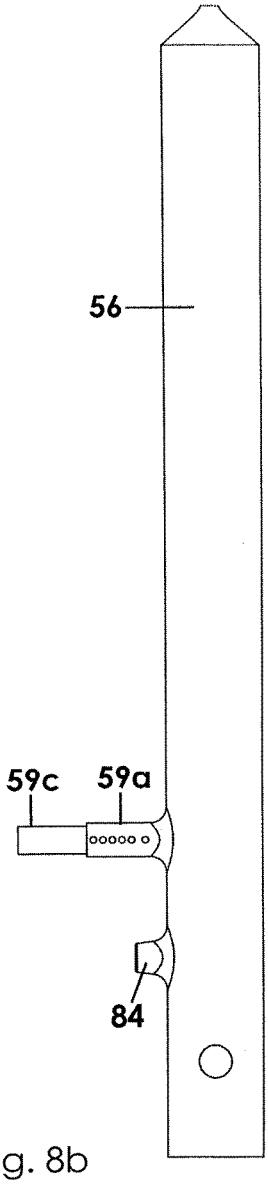
FIG. 8*b* is a side view of the hair retention member and hair clamping assembly as in FIG. 6*b;*
Figure 9:
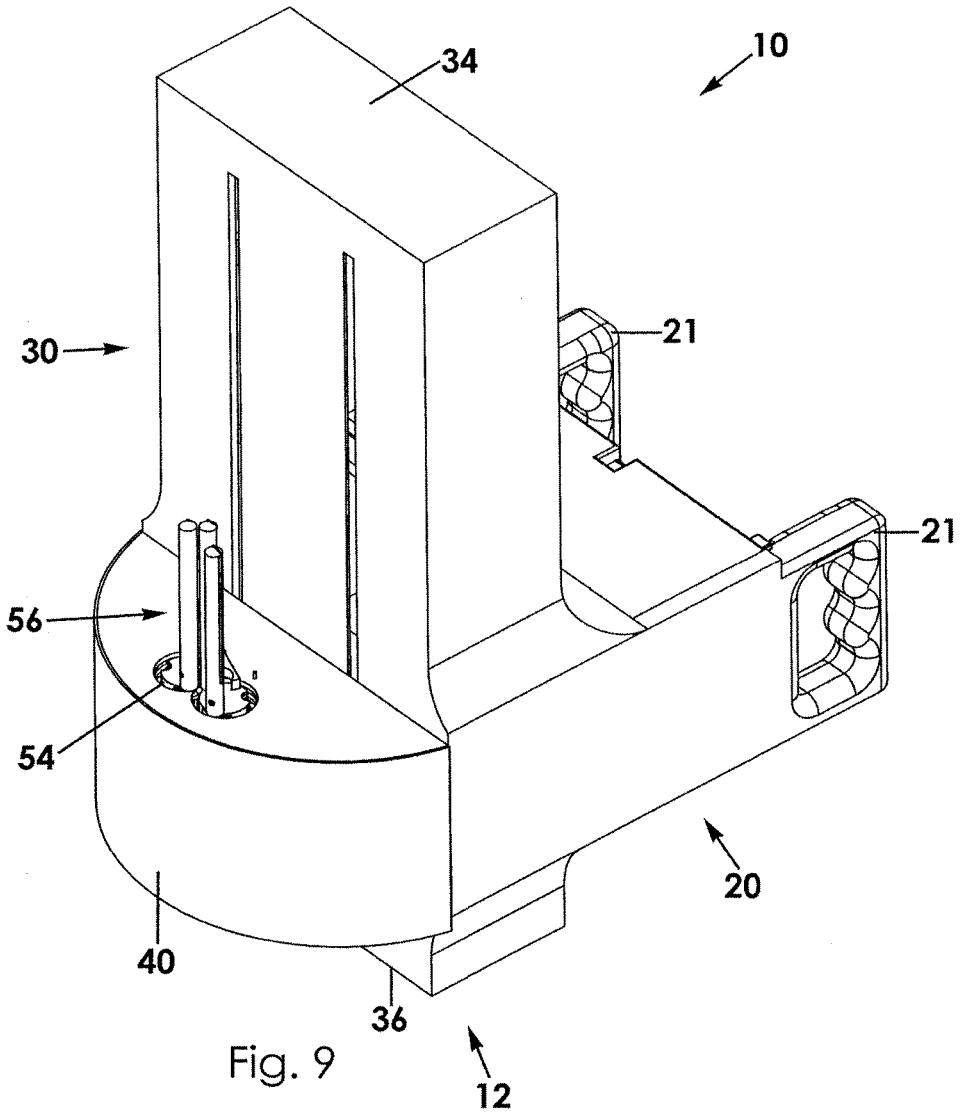
FIG. 9 is a perspective view of a hair braiding apparatus according to another embodiment of the present invention.
Figure 10:
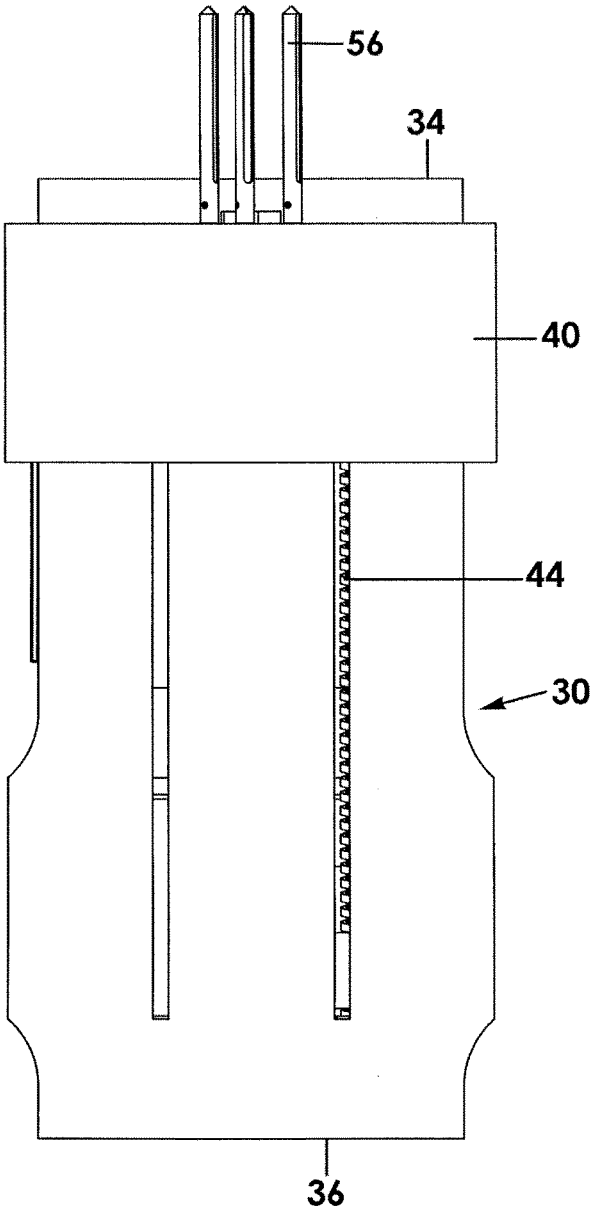
FIG. 10 is a front view of the hair braiding apparatus as in FIG. 9.
Figure 11:
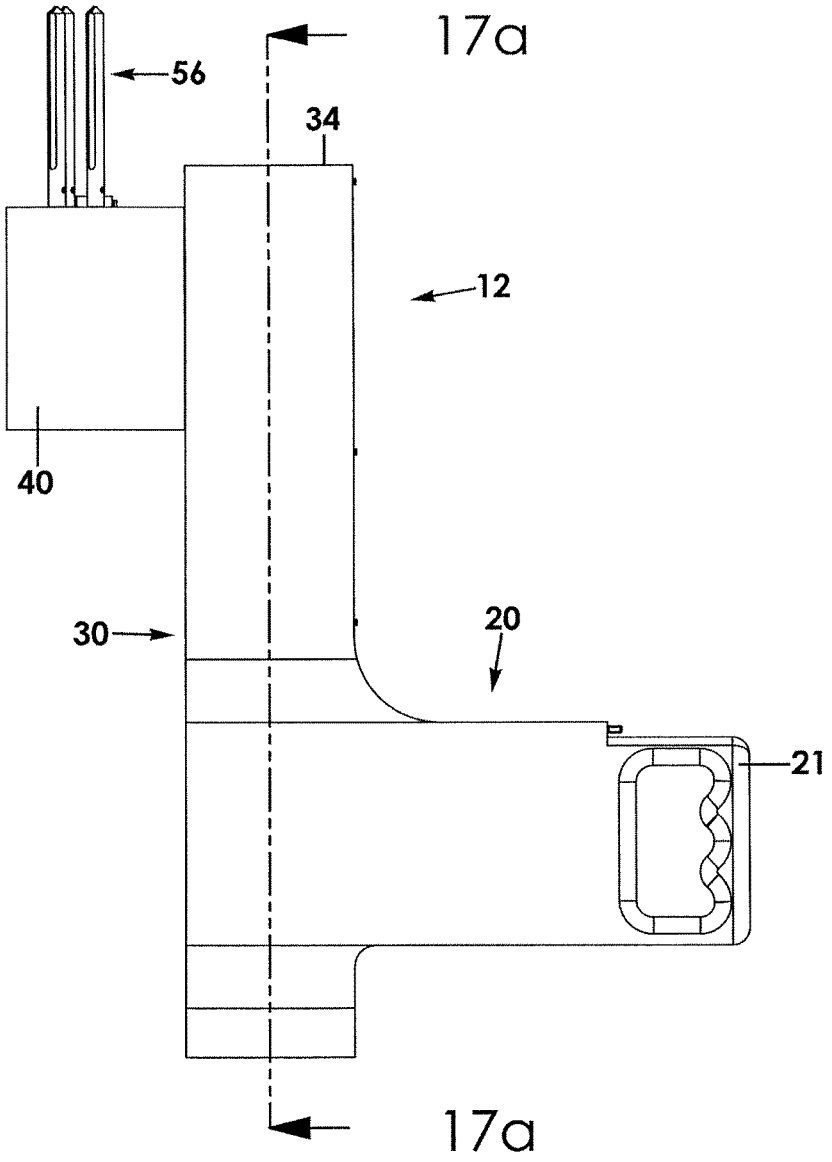
FIG. 11 is a side view of the hair braiding apparatus as in FIG. 9 illustrating the platform in a raised configuration.
Figure 12:
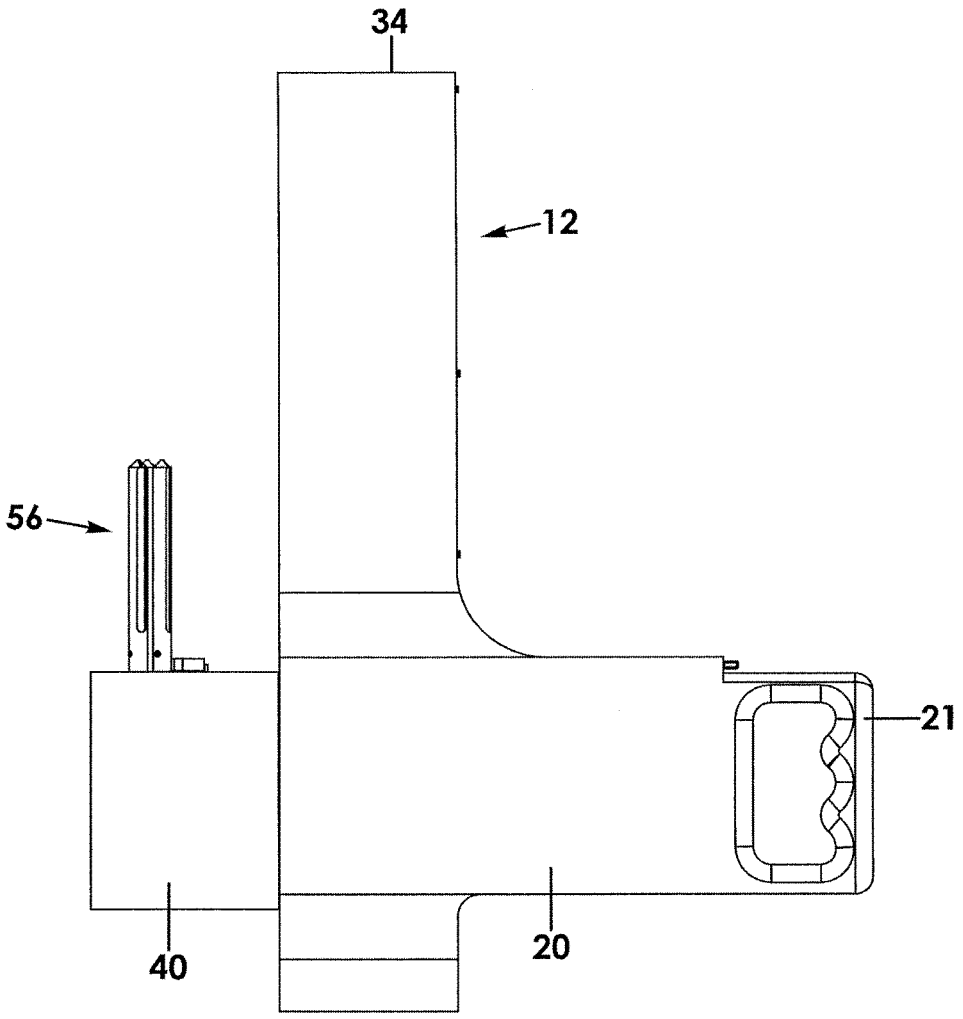
FIG. 12 is another side view of the hair braiding apparatus as in FIG. 9 illustrating the platform in a lowered configuration.
Figure 13:
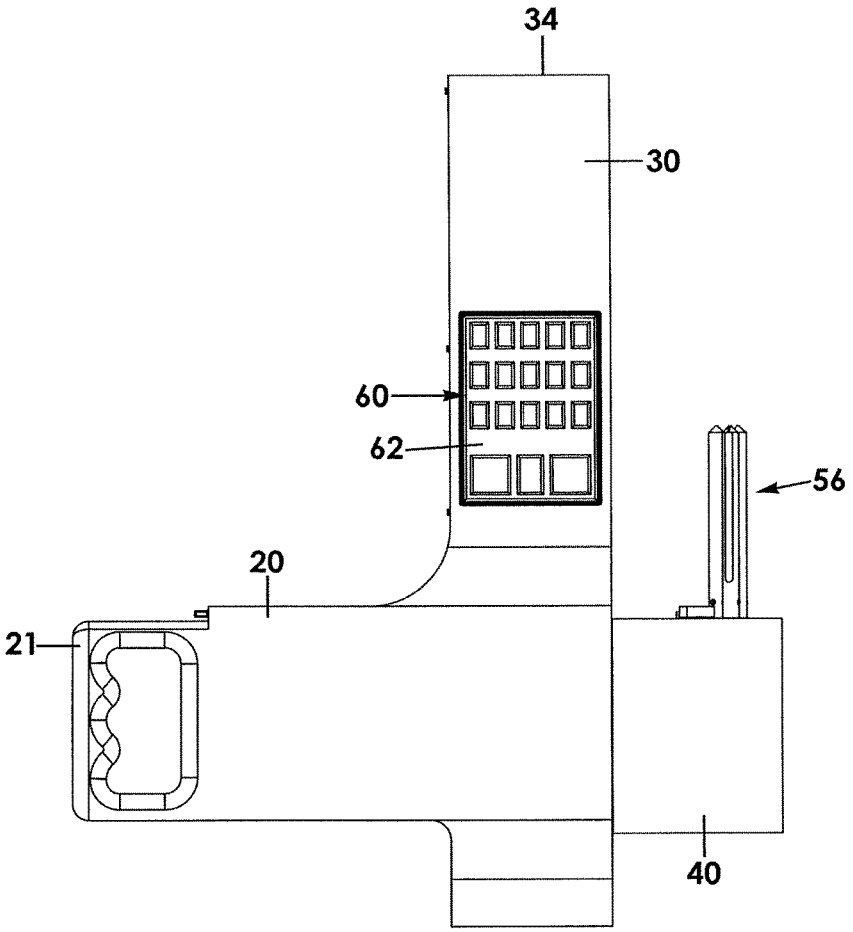
FIG. 13 is an opposite side view of the hair braiding apparatus as in FIG. 12.
Figure 14:
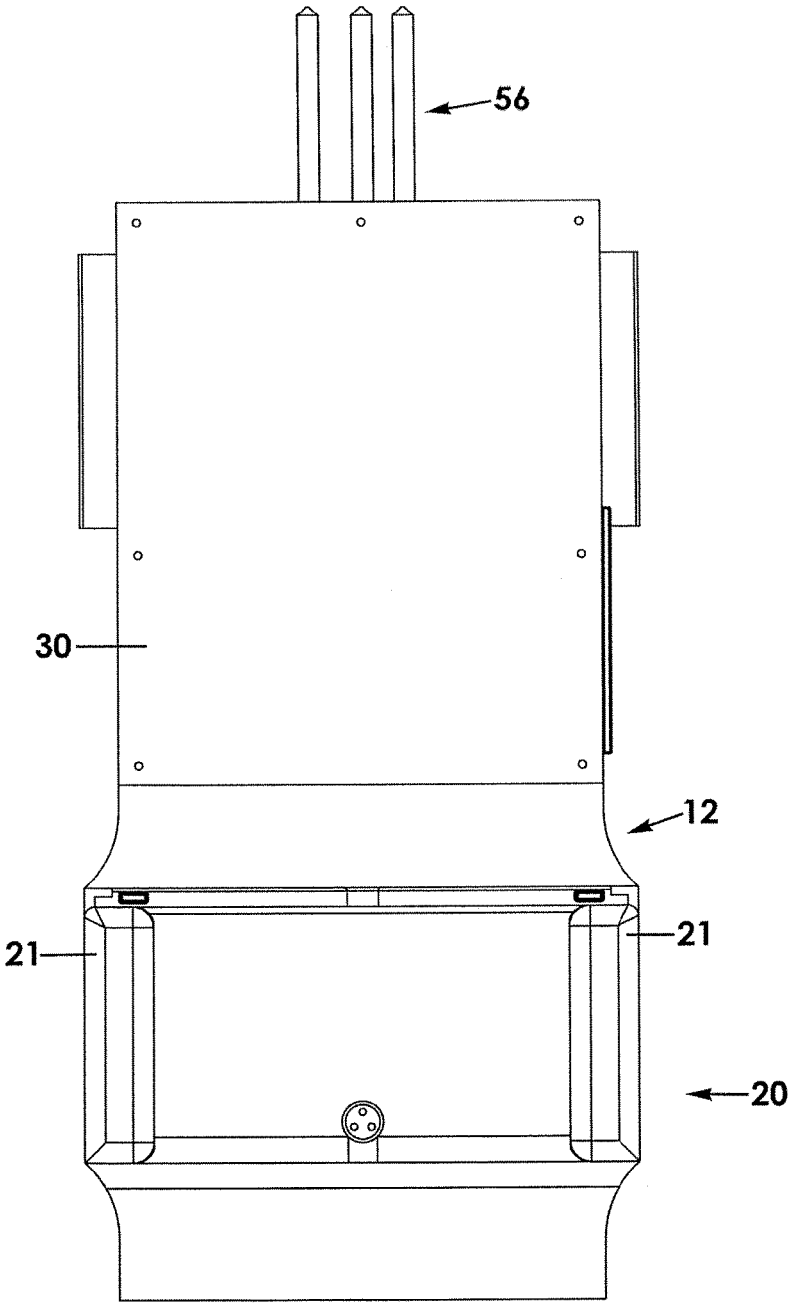
FIG. 14 is a rear view of the hair braiding apparatus as in FIG. 9 with the platform in a raised configuration.
Figure 15:
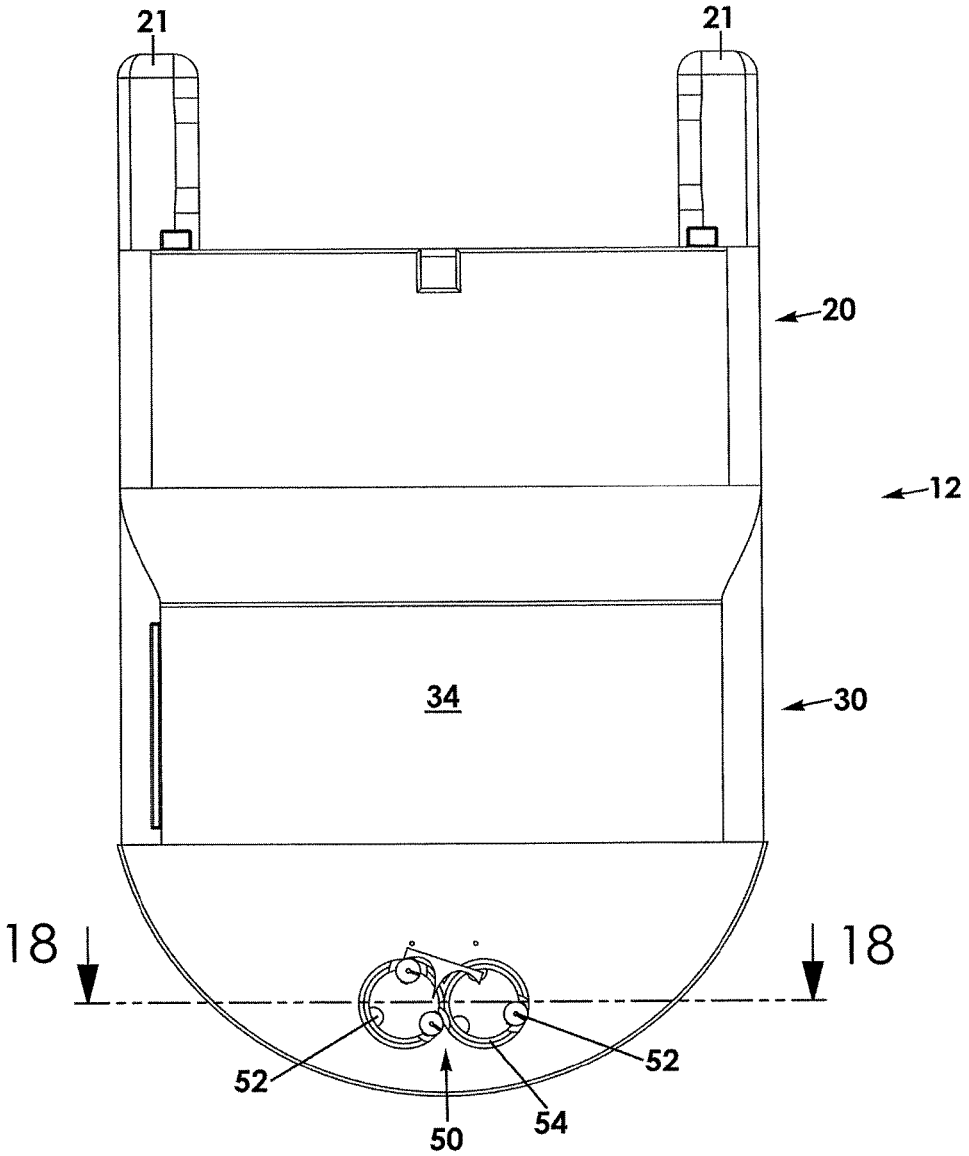
FIG. 15 is a top view of the hair braiding apparatus as in FIG. 9.
Figure 16:
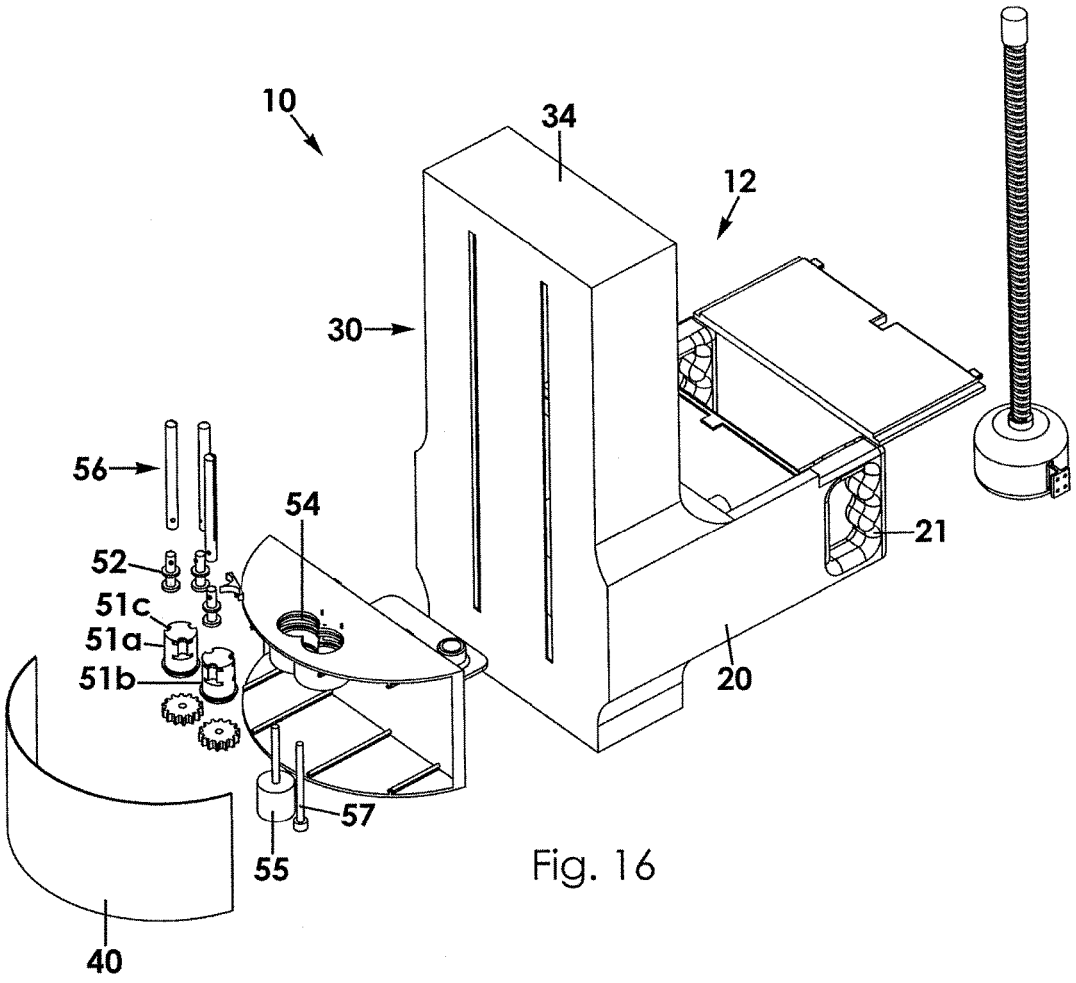
FIG. 16 is an exploded view of the hair braiding apparatus as in FIG. 9.
Figure 17:
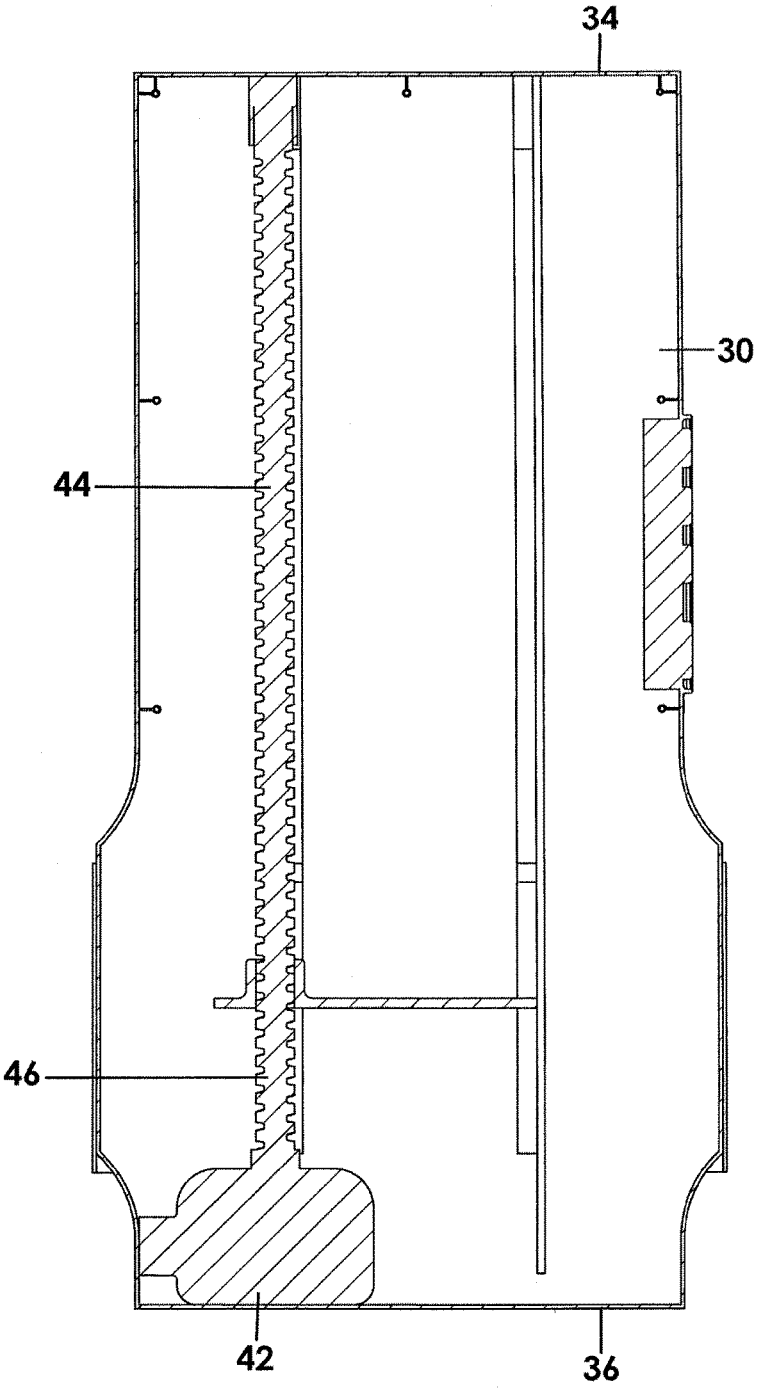
FIG. 17 is a sectional view taken along line 17*a*-17*a* of FIG. 11.
Figure 18:
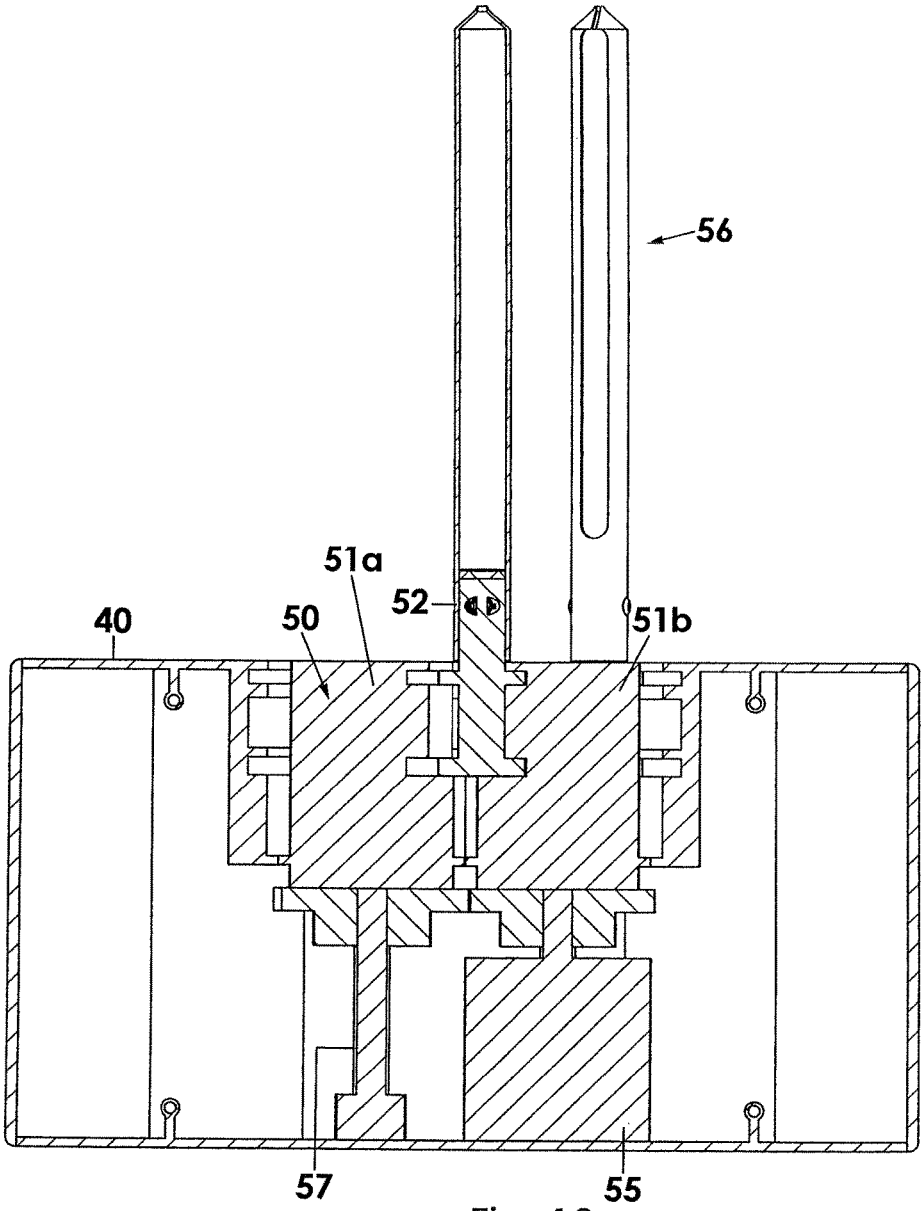
FIG. 18 is a sectional view taken along line 18-18 of FIG. 15.
Figure 19B:
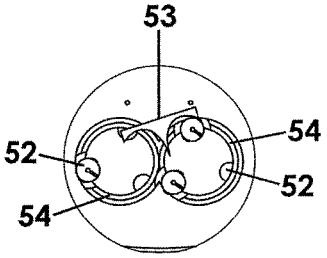
FIGS. 19*b*, 19*c*, 19*d*, and 19*e* are isolated views on an enlarged scale taken from FIG. 19*a* illustrating movement of a plurality of rotors under computer control.
Figure 19C:
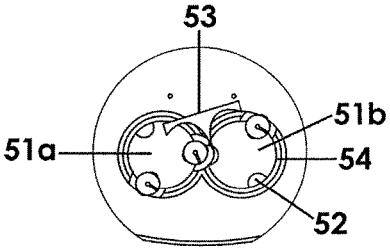
Figure 19D:
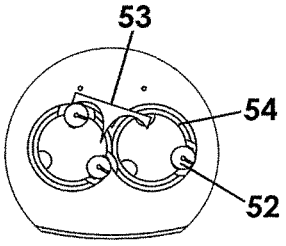
Figure 19E:
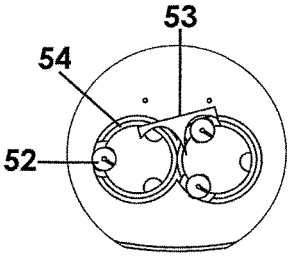
Figure 19A:
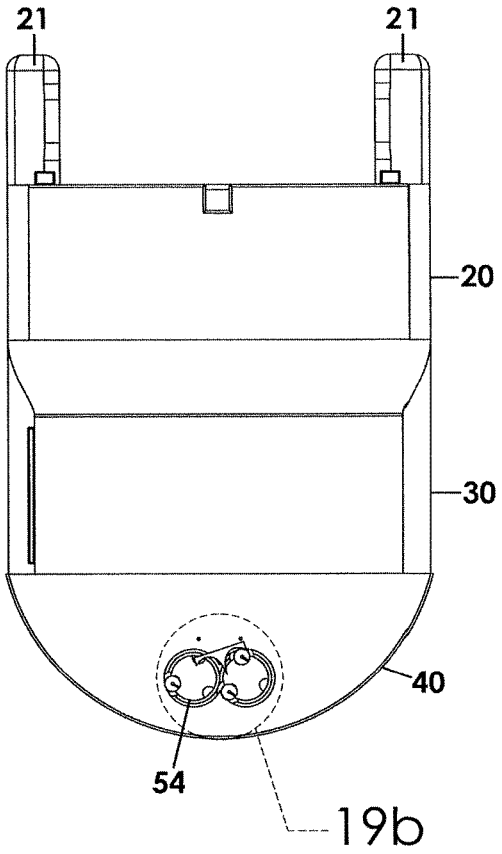
FIG. 19*a* is a top view of the hair braiding apparatus as in FIG. 1 with the hair retention members removed.
Figure 20C:
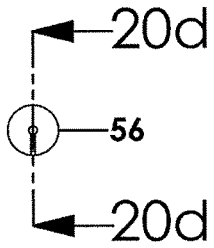
FIG. 20*c* is a top view of the hair retention member as in FIG. 20*a;*
Figure 20D:
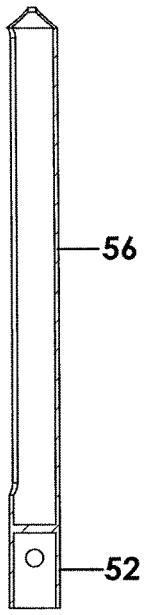
FIG. 20*d* is a sectional view taken along line 20*d*-20*d* taken from FIG. 20*c;*
Figure 20A:
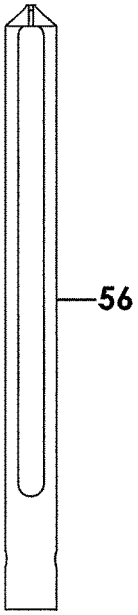
FIG. 20*a* is a side view of a small size hair retention member.
Figure 20B:
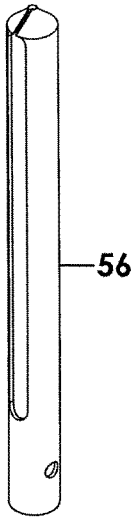
FIG. 20*b* is a perspective view of the hair retention member as in FIG. 20*a;*
Figure 21C:
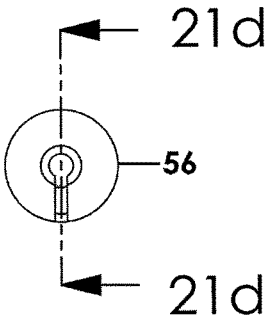
FIG. 21*c* is a top view of the hair retention member as in FIG. 21*a;*
Figure 21D:
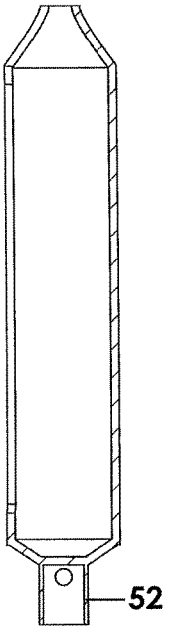
FIG. 21*d* is a sectional view taken along line 21*d*-21*d* taken from FIG. 21*c;*
Figure 21A:
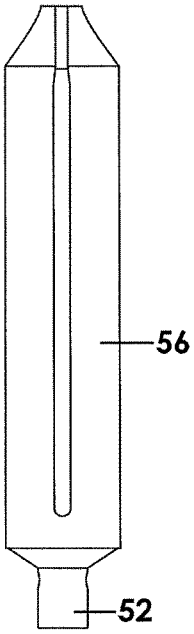
FIG. 21*a* is a side view of a large size hair retention member.
Figure 21B:
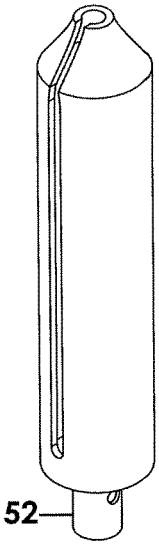
FIG. 21*b* is a perspective view of the hair retention member as in FIG. 21*a;*
Figure 22C:
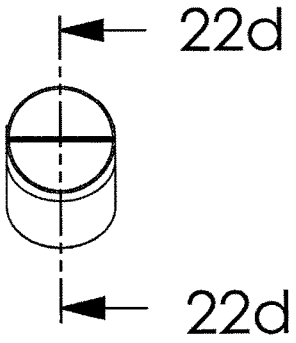
FIG. 22*c* is a top view of the rotor as in FIG. 22*a;*
Figure 22D:
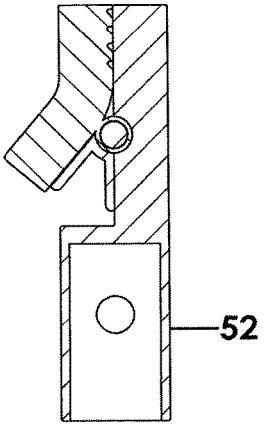
FIG. 22*d* is a sectional view taken along line 22*d*-22*d* taken from FIG. 22*c;*
Figure 22A:
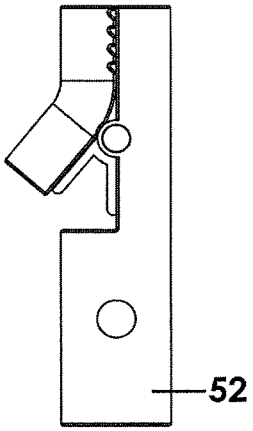
FIG. 22*a* is a side view of a respective rotor.
Figure 22B:
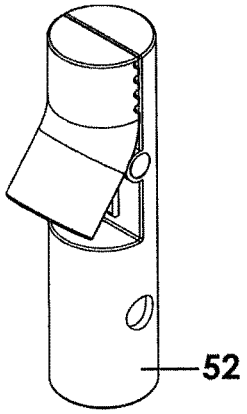
FIG. 22*b* is a perspective view of the rotor as in FIG. 22*a;*
Figure 23C:
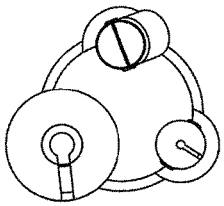
FIG. 23*c* is a top view of the rotor assembly as in FIG. 23*a*.
Figure 23A:
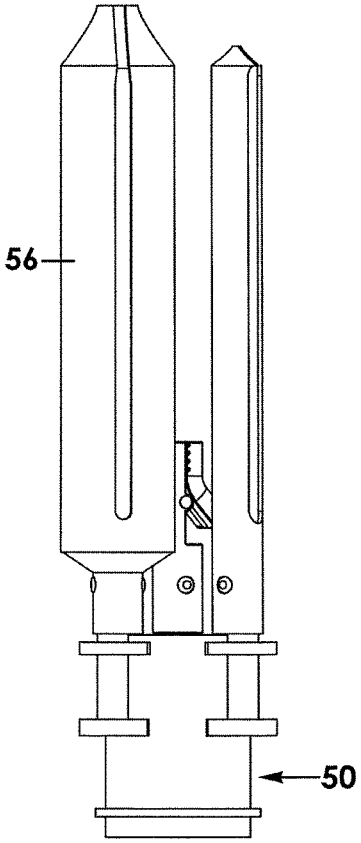
FIG. 23*a* is a side view of the rotor assembly of the braiding apparatus as in FIG. 9.
Figure 23B:
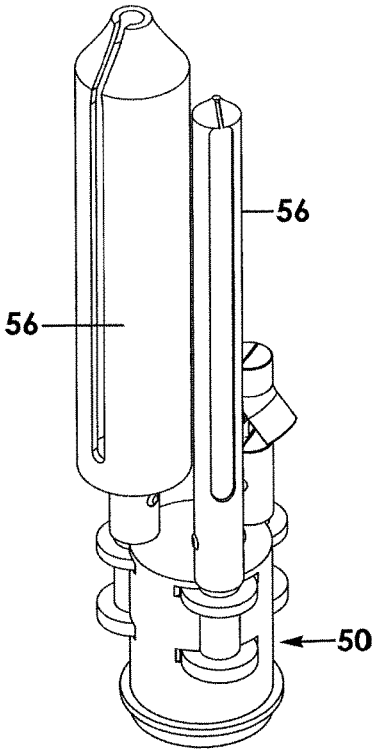
FIG. 23*b* is a perspective view of the rotor assembly as in FIG. 23*a;*
Figure 24:
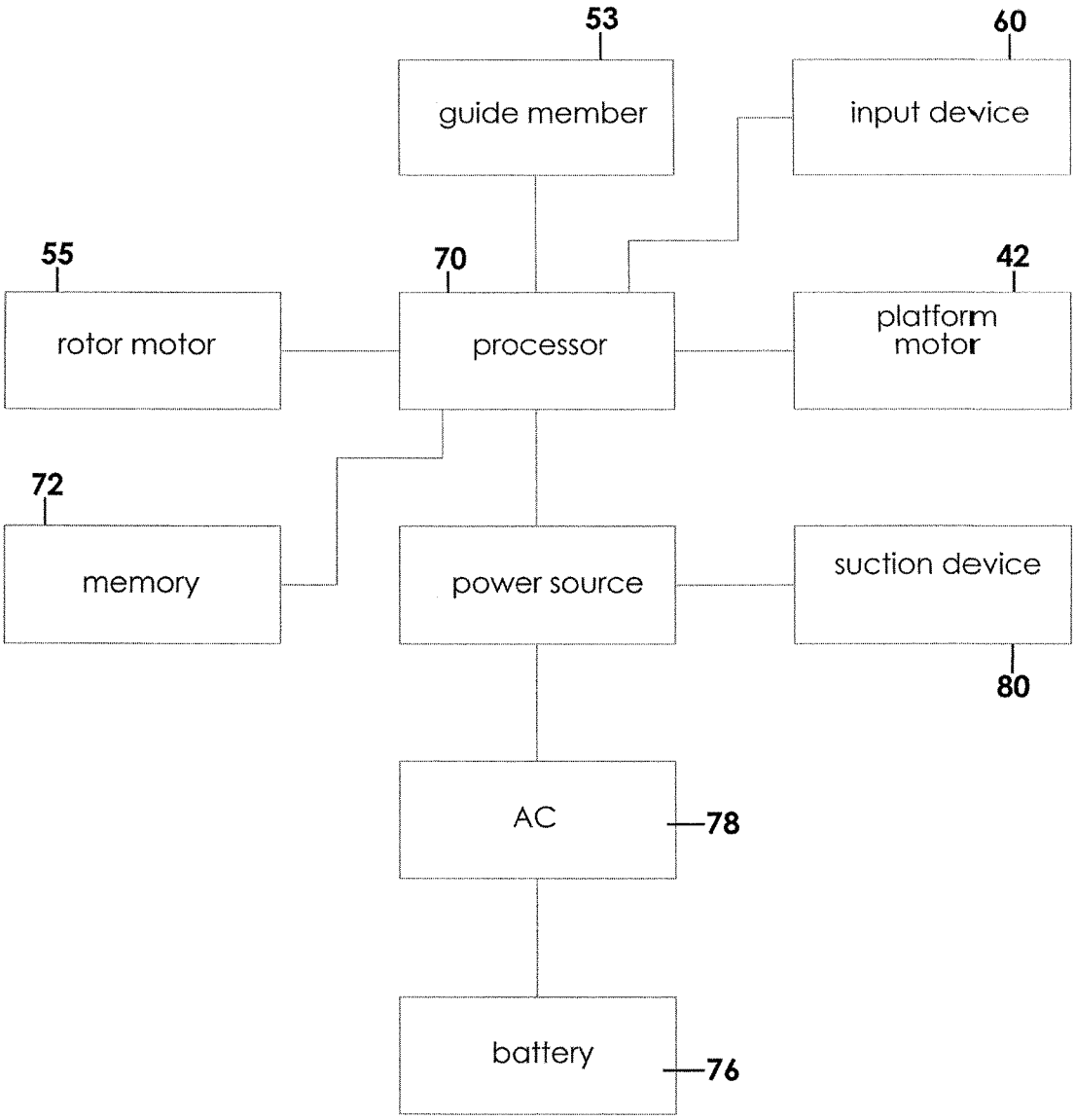
FIG. 24 is a block diagram of the electrical components of the present invention.

Now more particularly, the rotor assembly 50 includes a linkage having a pair of interconnected drive members including, more particularly, a first drive member 51*a* being rotatably coupled to the drive motor 55 and a second drive member 51*b* being rotatably coupled to the first drive member 51*a* (FIG. 5). In other words, the linkage may be in the form of a custom gear train having an upper portion that is positioned in communication with the pair of orbital tracks 54. The second drive member 51*b* may also be rotatably mounted on a support shaft 57 to maintain the second drive member 51*b* in its position relative to a respective orbital track. An upper portion of respective drive members 51*a*, 51*b* defines a plurality of spaced apart and peripherally positioned seats 51*c*, each seat 51*c* having a configuration capable of receiving or nesting respective rotors 52 as the rotors 52 are moved or "orbited" about the pair of orbital tracks 54.

Further, the rotor assembly 50 includes a guide member 53 pivotally mounted atop the pair of orbital tracks 54 (see FIGS. 19*b* to 19*e*) and is in electrical or wireless communication with the processor 70 that is executing programming instructions as will be described in more detail below. The guide member 53 is movable between a first configuration that directs a respective orbiting rotor 52 and hair retention member 56 to continue orbiting about the track it is currently in and a second configuration that directs a respective orbiting rotor 52 into an adjacent orbital track. In other words, the guide member 53 operates like a train track switch, i.e. the position of the guide member essentially defines the path of the pair of orbital tracks. When the guide member 53 "switches" position, the path of the orbital tracks 54 is changed.

The hair braiding apparatus 10 includes a plurality of hair retention members 56, each having an elongate configuration having one or more walls that together define a hair retention compartment accessible through an open top. Each hair retention member 56 is configured to receive a quantity of hair. For instance, a strand of hair that is to be used in forming a braid is first inserted into a respective hair retention member 56 and is then incrementally pulled therefrom as the hair style is formed upon operation of the rotors 52. Each hair retention member 56 includes a lower end appropriately configured to be releasably coupled to a respective rotor 52. Further, a set of smaller sized hair retention members (FIGS. 20*a* to 20*d*) may be used with persons with shorter hair or for some hair style applications while a set of larger sized hair retention members (FIGS. 21*a* to 21*d*) may be used with persons having longer or thicker hair or for other hair style applications.

Figure 2:
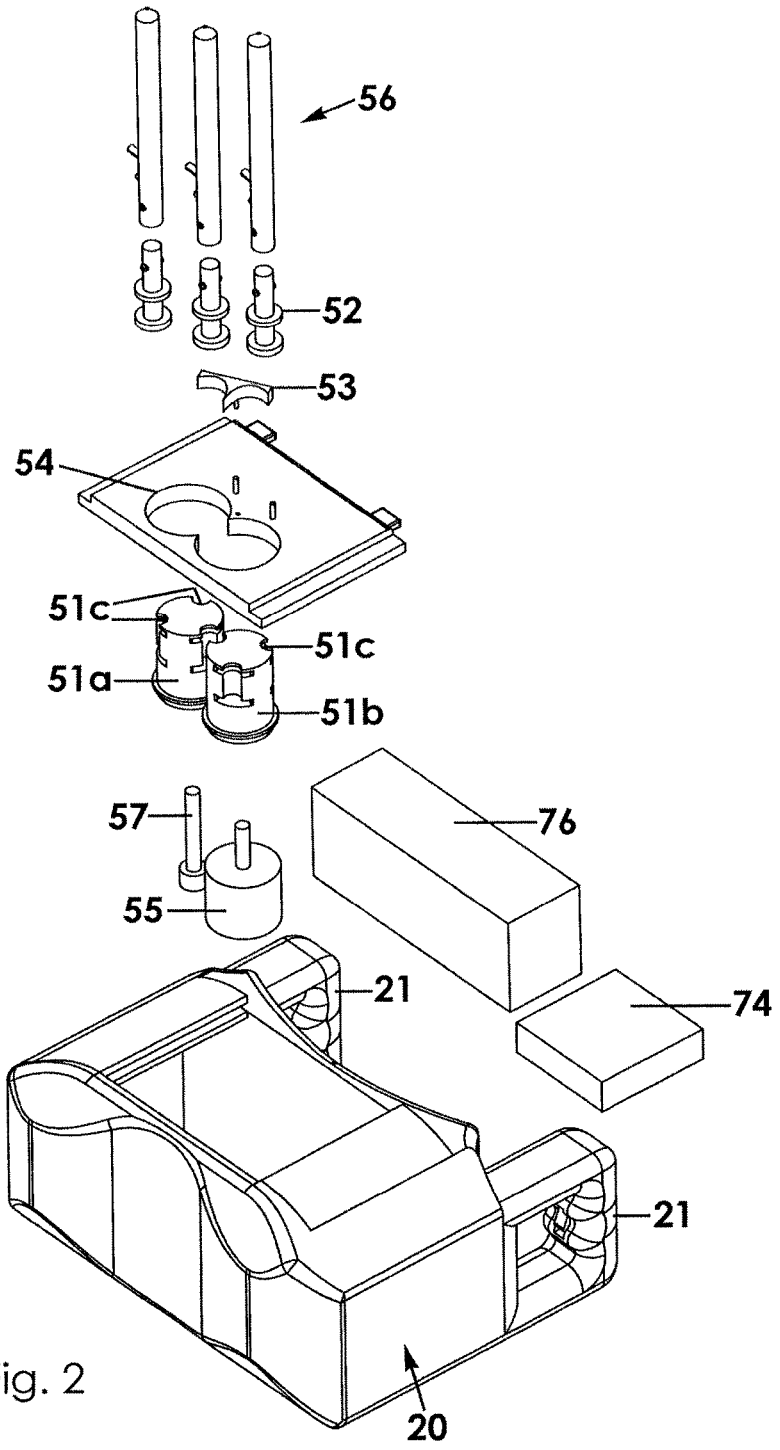
FIG. 2 is an exploded view of the braiding apparatus as in FIG. 1.
Figure 3:
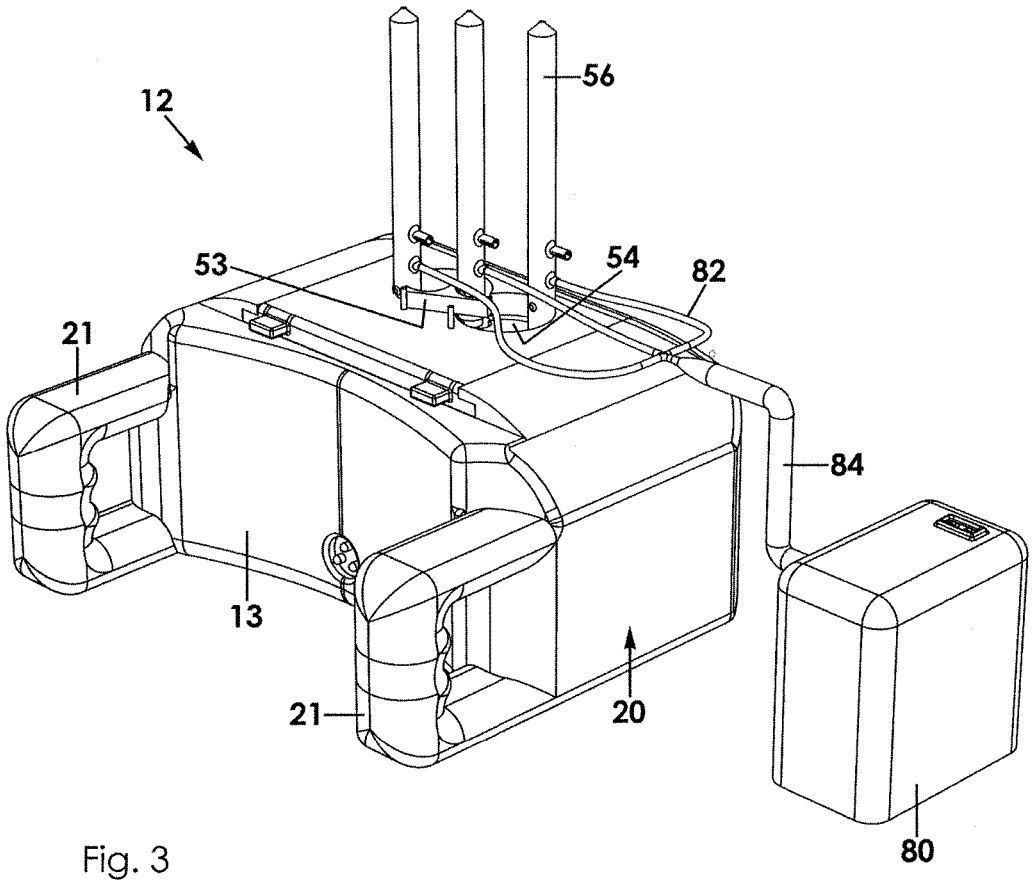
FIG. 3 is a rear perspective view of the braiding apparatus as in FIG. 1 illustrated in use with a suction device.
Figure 4A:
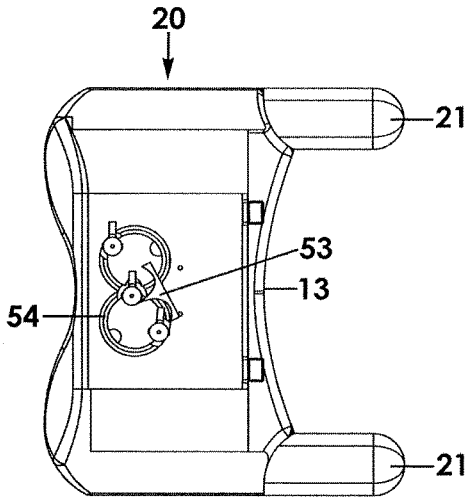
FIG. 4*a* is a top view of the braiding apparatus as in FIG. 1.
Figure 4B:
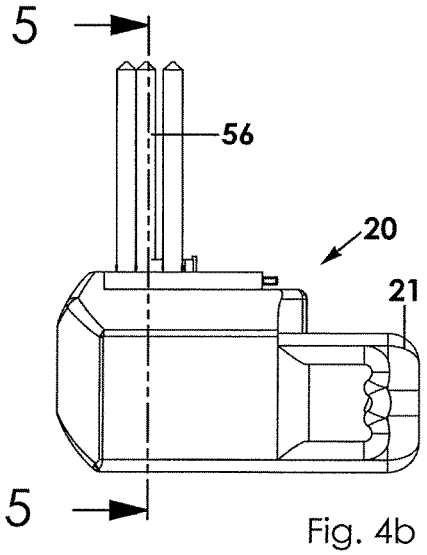
FIG. 4*b* is a side view of the braiding apparatus as in FIG. 1.
Figure 4C:
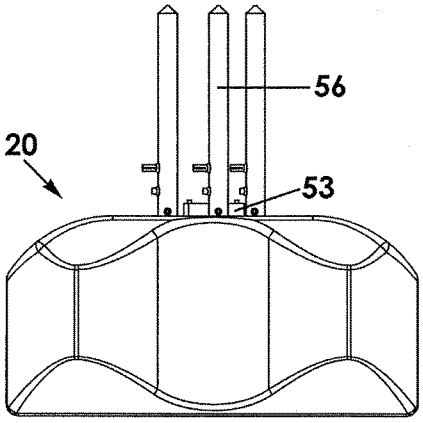
FIG. 4*c* is a front view of the braiding apparatus as in FIG. 1.

The hair braiding apparatus 10 includes a processor 70 situated in the lower portion 20 of the main housing 12 that is electrically connected to the battery 76 or alternate power source (FIG. 2). Further, a non-volatile storage medium, a.k.a., a memory 72, is situated in the lower portion 20 and electrically connected to the processor 70. The memory 72 is configured to store programming instructions and data for actuating the rotor motor 55 to move the rotors 52 along the orbital tracks 54 so as to braid a person's hair. Data in the memory 72 may associate a user input selection with a predetermined hair style and associated programming instructions. It is understood that the processor 70 and memory 72 may be incorporated onto a circuit board 74 (e.g. computer chip) or implemented as hard-wired circuitry. It is understood that respective programming instructions stored in memory 72 may be associated with moving the rotors 52 in a manner as to style strands of hair into other patterns that just a conventional braid. The electronic structures of the present invention are illustrated in the block diagram of FIG. 24).

The hair braiding apparatus 10 includes a user input device 60, such as a keypad or touch screen display 62, situated on a side of the main housing 12. The input device 60 is electrically connected to the processor 70 and enables a user or hair dresser to choose what braid or hair style pattern the rotor assembly 50 is to provide.

In another aspect of the invention described above, a suction device 80 or vacuum type device may be operatively connected to respective hair retention members and is configured to more efficiently draw and hold strands of hair therein. More particularly, the suction device 80 may include a plurality of hoses 82 connecting a main air channel 84 to a lower end of respective hair retention members 56. The suction device 80 may be electrically connected to an A/C power source or a battery and have an actuation switch for selectively actuating the device to cause air at the end of respective hose to begin suctioning air from respective hair retention members.

In an embodiment, the use of suction removes the need for hair locking clips or the like to be positioned inside or outside of respective hair retention members. In another embodiment, each hair retention member 56 may include a hair clamping assembly 59 that enables a user to clamp or otherwise hold a strand of hair in the hair retention member 56. More particularly, the hair clamping assembly 59 includes a stem section 59*a* defining a hollow channel in communication with the interior space of a hair retention member 56. Further, each hair clamping assembly 59 includes a clamp 59*c* having a rod-shaped configuration that is selectively received into the channel of a respective stem section 59*a* and into the hollow interior space of the hair retention member 56. The stem section 59*a* may define a plurality of spaced apart holes 59*b* and the clamp 59*c* may include a spring-loaded locking fastener 59*d* having a complementary configuration. In use, the clamp 59*c* may be pushed into the stem section 59*a* until a strand of hair in the interior space of a respective hair retention member 56 is secured against an interior wall therein. It is understood that the locking fastener 59*d* will nest (i.e. be releasably coupled) in a respective hole 59*b* of the stem section 59*a* such that the clamp 59*c* is held at a selected insertion position relative to the interior space of the hair retention member 56.

Another embodiment of the present invention is shown particularly in FIGS. 9 to 19*b* and may additionally involve the upper portion 30 of the main housing 12 having opposed front and rear walls that define an upper portion interior area 32 configured to contain operative components, such as a platform motor 42. Together, the lower portion 20 and upper portion 30 of the main housing 12 are configured to be placed on a tabletop or held near the head of a person whose hair is to be twisted into a selected hairstyle as will be described below. It is understood that like components are numbered as in the embodiment first discussed above and shown in FIGS. 1 to 5.

A platform motor 42 is positioned near the bottom of the upper portion 30 of the main housing 12. The lower end 46 of a worm gear 44 is operatively coupled to the platform motor 42 and extends upwardly therefrom. A platform housing 40 is operatively coupled to the worm gear 44 and movable between a raised configuration adjacent an upper end 34 of the upper portion 30 and a lower end 36 of the upper portion 30 when the platform motor 42 is actuated to rotate the worm gear 44. The platform housing 40 is incrementally lowered along the front wall during operation of performing a braiding or other weaving operation as will be described later. In this embodiment, the rotor assembly 50 described above is mounted in the platform housing 40. Also in this embodiment, the programming instructions stored in memory 72 may include steps associated with actuating the platform motor 42 to move the platform housing 40 downwardly during a hair styling operation.

In use, a beautician or stylist should part or separate the person's hair into the number of strands needed to produce a desired hair style. Then, the strands may be inserted into respective hair retention members 56 and selectively secured by operation of the suction device 80 as described above. The input device 60 is then used to select a desired braid or other hair style (such as by pressing a manual or touch screen menu). The user may then activate operation of the apparatus 10 by pressing a start button via the input device.

Accordingly, the rotors 52 will begin to cycle about respective orbital tracks 54 per instructions in memory 72 being executed by the processor 70. As described above, the processor 70 may actuate the guide member 53 to "switch" its position so as to direct or re-direct an orbiting rotor 52 into an adjacent orbital track. In one embodiment, the processor 70 may also actuate the platform motor 42 to rotate the worm gear 44 which operates the platform housing 40 to move downwardly along the front side of the upper portion 30 of the main housing 10 in consideration of the hair being pulled out of the respective retention members 56 and formed into the hair style.

It is understood that the platform housing 40, associated means for moving the platform housing 40, and an auxiliary rotor assembly associated with the platform housing 40 may be incorporated into the embodiment of the hair braiding apparatus first described above and shown in FIGS. 1 to 5. In other words, a hair braiding apparatus having a rotor assembly 50 in the lower portion 20 and in a platform housing 40 is possible in order to provide optional or selective use by a hair dressing professional.

It should be understood, of course, that the foregoing relates to exemplary embodiments of the invention and that modifications may be made without departing from the spirit and scope of the invention.

The invention claimed is:

1. A hair braiding apparatus, comprising:

a main housing having a lower portion that includes wall structures defining a lower interior area;

a rotor assembly mounted to said lower portion, said rotor assembly having a rotor motor positioned in said interior area of said lower interior area and a plurality of rotors in operative communication with said rotor motor and extending upwardly;

a pair of orbital tracks situated atop said lower portion that are configured to receive respective rotors of said plurality of rotors;

a plurality of hair retention members coupled to respective rotors, each retention member extending upwardly and defining a hair retention compartment having an open top capable of receiving a strand of hair into said hair retention compartment;

a processor situated in said lower portion of said main housing and electrically connected said rotor motor;

a memory electrically connected to said processor and configured to store programming instructions related to controlling movements of said plurality of rotors along said orbital tracks;

wherein said processor, upon execution of respective programming instructions, is configured to energize said rotor motor to move said plurality of rotors along said pair of orbital tracks so as to style the strands of hair in said hair retention members;

wherein said main housing includes an upper portion extending upwardly from said lower portion and defining an upper interior area, said hair braiding apparatus further comprising:

a platform motor positioned in said upper portion and electrically connected to said processor;

a worm gear situated in said upper portion and having a lower end operatively coupled to said platform motor and having an opposed upper end;

a platform housing mounted on a front side of said upper portion and coupled to said worm gear, said platform housing configured to move incrementally downwardly along said worm gear when said platform motor is energized.

2. The hair braiding apparatus as in claim 1, further comprising a suction device operatively coupled to said plurality of hair retention members and configured to draw into and hold respective strands of hair into said plurality of hair retention members, respectively, when energized.

3. The hair braiding apparatus as in claim 2, wherein said rotor assembly includes:

a linkage having a pair of drive members rotatably coupled to said drive motor and extending upwardly into communication with said pair of orbital tracks, said pair of drive members defining a plurality of seats configured to selectively receive respective rotors therein; and a guide member pivotally coupled atop said pair of orbital tracks and in electrical communication with said processor, said guide member being movable between a first configuration directing a respective rotor to continue orbiting in a same orbital track and a second configuration directing a respective rotor to orbit in an adjacent orbital track according to respective programming instructions executed by said processor.

4. The hair braiding apparatus as in claim 2, wherein each hair retention member includes a hair clamping assembly, said hair clamping assembly comprising:

a stem section extending from a side wall of said hair retention member and defining a channel in communication with an interior space of said hair retention member; and a clamp selectively received into said stem section and slidably movable into or out of said interior space of said hair retention member.

5. The hair braiding apparatus as in claim 4, wherein:

said stem section defines a plurality of spaced apart adjustment holes;

said clamp includes a spring-loaded fastener configured to selectively nest in a respective adjustment hole so as to hold said clamp at a selected insertion position relative to said interior space of said hair retention member.

6. The hair braiding apparatus as in claim 1, wherein said rotor assembly includes:

a linkage having a pair of drive members rotatably coupled to said drive motor and extending upwardly into communication with said pair of orbital tracks, said pair of drive members defining a plurality of seats configured to selectively receive respective rotors therein; and a guide member pivotally coupled atop said pair of orbital tracks and in electrical communication with said processor, said guide member being movable between a first configuration directing a respective rotor to continue orbiting in a same orbital track and a second configuration directing a respective rotor to orbit in an adjacent orbital track according to respective programming instructions executed by said processor.

7. The hair braiding apparatus as in claim 6, further comprising a pair of spaced apart handles coupled to a rear wall of said lower portion of said main housing and extending rearwardly.

8. The hair braiding apparatus as in claim 1, wherein said programming instructions are related to forming hair style patterns taken from a group consisting of braiding, weaving, and corn rolls.

9. The hair braiding apparatus as in claim 1, further comprising a handle coupled to said main housing and extending rearwardly therefrom.

10. The hair braiding apparatus as in claim 1, further comprising an input device situated on said main housing and electrically connected to said processor, said input device configured to receive user selection data related to a hair style associated with respective programming instructions.

11. The hair braiding apparatus as in claim 1, wherein:

said processor is electrically connected to said platform motor and configured to selectively energize said platform motor upon execution of said programming instructions;

said rotor assembly is positioned in said platform housing and said orbital tracks are situated atop said platform housing so that said platform housing is selectively moved incrementally downwardly and said rotors are moved about said pair of orbital tracks when said processor, upon execution of respective programming instructions, energizes said platform motor and said rotor motor.

12. A hair braiding apparatus, comprising:

a main housing having a lower portion and a upper portion extending upwardly from said lower portion, said lower portion defining a lower interior area and said upper portion defining a upper interior area;

a processor situated in said lower portion of said main housing;

a platform motor positioned in said upper portion and electrically connected to said processor;

a worm gear situated in said upper portion and having a lower end operatively coupled to said platform motor and having an opposed upper end;

a platform housing mounted on a front side of said upper portion and coupled to said worm gear, said platform housing configured to move incrementally downwardly along said worm gear when said platform motor is energized a rotor assembly mounted atop said upper portion, said rotor assembly having a rotor motor electrically connected to said processor and positioned in said interior area of said lower interior area and having a plurality of rotors in operative communication with said rotor motor and extending upwardly;

a pair of orbital tracks situated atop said platform housing that are configured to receive respective rotors of said plurality of rotors;

a plurality of hair retention members coupled to respective rotors, each retention member extending upwardly and defining a hair retention compartment having an open top capable of receiving a strand of hair into said hair retention compartment;

a memory electrically connected to said processor and configured to store programming instructions related to controlling movements of said plurality of rotors along said orbital tracks;

wherein said processor, upon execution of respective programming instructions, is configured to energize said rotor motor to move said plurality of rotors along said pair of orbital tracks so as to style the strands of hair in said hair retention members.

13. The hair braiding apparatus as in claim 12, further comprising a suction device operatively coupled to said plurality of hair retention members and configured to draw into and hold respective strands of hair into said plurality of hair retention members, respectively, when energized.

14. The hair braiding apparatus as in claim 13, wherein said rotor assembly includes:

a linkage having a pair of drive members rotatably coupled to said drive motor and extending upwardly into communication with said pair of orbital tracks, said pair of drive members defining a plurality of seats configured to selectively receive respective rotors therein; and a guide member pivotally coupled atop said pair of orbital tracks and in electrical communication with said processor, said guide member being movable between a first configuration directing a respective rotor to continue orbiting in a same orbital track and a second configuration directing a respective rotor to orbit in an adjacent orbital track according to respective programming instructions executed by said processor.

15. The hair braiding apparatus as in claim 12, wherein said rotor assembly includes:

a linkage having a pair of drive members rotatably coupled to said drive motor and extending upwardly into communication with said pair of orbital tracks, said pair of drive members defining a plurality of seats configured to selectively receive respective rotors therein; and a guide member pivotally coupled atop said pair of orbital tracks and in electrical communication with said processor, said guide member being movable between a first configuration directing a respective rotor to continue orbiting in a same orbital track and a second configuration directing a respective rotor to orbit in an adjacent orbital track according to respective programming instructions executed by said processor.

16. The hair braiding apparatus as in claim 15, further comprising a pair of spaced apart handles coupled to a rear wall of said lower portion of said main housing and extending rearwardly.

17. The hair braiding apparatus as in claim 12, wherein said programming instructions are related to forming hair style patterns taken from a group consisting of braiding, weaving, and corn rolls.

18. The hair braiding apparatus as in claim 12, further comprising a handle coupled to said main housing and extending rearwardly therefrom.

19. The hair braiding apparatus as in claim 12, further comprising an input device situated on said main housing and electrically connected to said processor, said input device configured to receive user selection data related to a hair style associated with respective programming instructions.

20. The hair braiding apparatus as in claim 12, wherein said memory is a non-volatile memory storage device.

* * * * *